US007190127B2

(12) United States Patent
Rudolph

(10) Patent No.: US 7,190,127 B2
(45) Date of Patent: Mar. 13, 2007

(54) SHUTDOWN CIRCUIT

(75) Inventor: Bernd Rudolph, Forstern (DE)

(73) Assignee: Patent-Treuhand-Gesellschaft fur Elektrisch Gluhlampen MBH (DE)

( * ) Notice: Subject to any disclaimer, the term of this patent is extended or adjusted under 35 U.S.C. 154(b) by 0 days.

(21) Appl. No.: 11/455,089

(22) Filed: Jun. 19, 2006

(65) Prior Publication Data

US 2006/0284566 A1 Dec. 21, 2006

(30) Foreign Application Priority Data

Jun. 20, 2005 (DE) ..... 10 2005 028 419

(51) Int. Cl.
*G05F 1/00* (2006.01)

(52) U.S. Cl. ..... 315/309; 315/307; 315/291

(58) Field of Classification Search ..... 315/309, 315/307, 291, 224, 225, 209 R
See application file for complete search history.

(56) References Cited

U.S. PATENT DOCUMENTS 6,650,514 B2 * 11/2003 Schmitt ..... 361/18
2004/0080283 A1 * 4/2004 Mayer et al. ..... 315/247
2004/0130273 A1 * 7/2004 Alexandrov ..... 315/291

* cited by examiner

*Primary Examiner*—Tuyet Thi Vo
(74) *Attorney, Agent, or Firm*—Fitch, Even, Tabin & Flannery

(57) ABSTRACT

The invention relates to an electronic ballast for operating a discharge lamp LA, in which a pump circuit D6, C8, C9, L1 charges an intermediate circuit capacitor C6 from the AC voltage of a converter V1, V2. A voltage limitation circuit R8, R3, D5, R4, R5, C3, SD is connected in parallel with the intermediate circuit capacitor C6. A dissipation element R8 in the voltage limitation circuit R8, R3, D5, R4, R5, C3, SD converts electrical energy into thermal energy when a maximum value for the voltage across the intermediate circuit capacitor C6 is exceeded. The current through the measuring resistor R3 is measured as the voltage UC3 across the measuring resistor R3, is detected in a delay circuit R4, R5, C3 and is used to control a shutdown device SD for the converter V1, V2.

13 Claims, 1 Drawing Sheet

SHUTDOWN CIRCUIT

TECHNICAL FIELD

The invention relates to an electronic ballast for operating a discharge lamp.

PRIOR ART

Electronic ballasts for operating discharge lamps are known in a wide variety of embodiments. They generally contain a rectifier circuit for rectifying an AC voltage supply and charging a capacitor, which is often referred to as an intermediate circuit capacitor. The DC voltage applied to this capacitor is used for supplying a converter, which drives the discharge lamp. In principle, a converter produces a supply voltage for the discharge lamp to be operated using a radiofrequency current from a rectified AC voltage supply or a DC voltage supply. Converters generally produce this radiofrequency AC voltage via switching elements which operate in opposition.

One important property of such ballasts is the type of power withdrawal from the supply system. If the rectifier charges an intermediate circuit capacitor, charging operations of the intermediate circuit capacitor only result without further measures if the instantaneous system voltage is above the voltage across the intermediate circuit capacitor. A poor power factor is the consequence.

There are various possible ways of improving the power factor. In addition to converters—for example step-up converter circuits—for charging the intermediate circuit capacitor from the rectified system voltage, so-called pump circuits also come into consideration. These pump circuits require a comparatively low degree of complexity in terms of circuitry.

The topology of a pump circuit includes the rectified supply voltage from the power supply system being coupled to the intermediate circuit capacitor via at least one electronic pump switch. This results in a pump node between the rectifier and the electronic pump switch. This pump node is coupled to the converter output via a pump network.

The principle of the pump circuit consists in the fact that, during one half-cycle of the converter activity, energy is drawn from the rectified supply voltage via the pump node and buffer-stored in the pump network. In the subsequent half-cycle, the buffer-stored energy is fed to the intermediate circuit capacitor via the electronic pump switch.

Accordingly, energy is drawn from the rectified supply voltage in time with the converter frequency which is high in comparison with the frequency of the system supply.

SUMMARY OF THE INVENTION

The invention is based on the technical problem of specifying an improved electronic ballast having a pump circuit and an associated operating method.

The invention relates to an electronic ballast for operating a discharge lamp (LA), which has:

- a converter (V1, V2) for producing a radiofrequency AC voltage,
- an intermediate circuit capacitor (C6) for supplying (UC6) a DC voltage to the converter (V1, V2),
- and a pump circuit (D6, C8, C9, L1), which charges the intermediate circuit capacitor (C6) from the AC voltage of the converter (V1, V2), characterized by a voltage limitation circuit (R8, R3, D5, R4, R5, C3, DZ3), which is connected in parallel with the intermediate circuit capacitor (C6), for limiting the voltage (UC6) across the intermediate circuit capacitor (C6), which has:

- a series circuit (R3, R8) having a dissipation element (R8) and a measuring resistor (R3),
- a delay circuit (R4, R5, C3),
- and a shutdown device (SD), which has a threshold value element (DZ3), which defines a switching voltage (UC3) across the delay circuit (R4, R5, C3), and whose output signal deactivates the converter (V1, V2) when the maximum voltage (UC3) is exceeded, the dissipation element (R8) converting electrical energy into thermal energy when a maximum value for the voltage (UC6) across the intermediate circuit capacitor (C6) determined by the dissipation element is exceeded, and the current through the measuring resistor (R3) being measured as the voltage (UR3) across said measuring resistor (R3), being detected in the delay circuit (R4, R5, C3), and being fed to the shutdown device (SD) as the input signal (UC3), and to a corresponding operating method.

Preferred refinements of the invention are given in the dependent claims and will be explained in more detail below. The disclosure always relates to both the method aspect and the apparatus aspect of the invention.

The invention is based on the knowledge that, as soon as and as long as the converter is activated, the pump circuit draws energy from the rectified system voltage and feeds it to the intermediate circuit capacitor via the electronic pump switch. The converter is generally activated when the electronic ballast is switched on. Further open-loop or closed-loop control of the pump circuit does not normally take place. Without a sufficient load connected to the converter, the pump circuit increases the voltage across the intermediate circuit capacitor. High voltages across the intermediate circuit capacitor endanger the components in the electronic ballast, in particular the intermediate circuit capacitor itself.

The components in the pump circuit and the other components of the electronic ballast are generally matched to the system supply and the load, i.e. the discharge lamp, such that the voltage across the intermediate circuit capacitor is maintained in the vicinity of a fixed value during normal operation. For example, the voltage across the intermediate circuit capacitor can be set such that it is always slightly above the voltage maximum of the rectified AC voltage supply.

There are various reasons why the converter can be activated in the electronic ballast without a corresponding load being connected. For example, it is possible that there is no discharge lamp at all connected to the electronic ballast, but the ballast is switched on. It is also possible that the discharge lamp fails or is damaged during operation, the discharge is extinguished, and thus there is no longer any load connected to the electronic ballast. In particular, it is also possible that, in the case of an intact discharge lamp which is connected, the gas discharge cannot be started quickly enough, as may be the case with discharge lamps especially towards the end of their life. The list of these examples is not exhaustive.

In order to avoid overvoltages at the intermediate circuit capacitor, the invention has a voltage limitation circuit connected in parallel with the intermediate circuit capacitor.

This voltage limitation circuit has a plurality of components: a series circuit comprising a dissipation element and a measuring resistor, a delay circuit and a shutdown device. The shutdown device has a threshold value element, which defines a switching voltage for the shutdown device via the delay circuit. If the voltage across the intermediate circuit capacitor exceeds a maximum voltage determined by the properties of the dissipation element, a notable current flows through the series circuit comprising the dissipation element and the measuring resistor. In this case, electrical energy is converted into thermal energy by the dissipation element. The current through the measuring resistor is measured as the voltage across said measuring resistor and is detected in the delay circuit. If this voltage in the delay circuit exceeds the switching voltage defined by the threshold value element, the converter is deactivated by the shutdown device.

In one preferred embodiment of the invention, the dissipation element is a varistor. A varistor has a very high resistance value at low voltages and has a low resistance value when a specific voltage is exceeded. However, the voltage at which this takes place may vary considerably from varistor to varistor—and during the life of a varistor. A varistor can convert relatively large amounts of energy into heat for short periods of time. However, for longer time intervals, the maximum power consumption is less. The use of a varistor is particularly advantageous since it is a very inexpensive component.

The shutdown device is preferably in the form of a bistable shutdown device. If the voltage detected in the delay circuit exceeds, in terms of its absolute value, a specific switching voltage, the shutdown device operates and deactivates the converter. If the detected voltage in the delay circuit falls, the shutdown device only operates again if a further switching point, which is smaller in terms of absolute value, is undershot. When the lower switching threshold is undershot, the converter is reactivated.

The shutdown device preferably has a zener diode as the threshold value element. Zener diodes are inexpensive and stable components.

In one preferred embodiment of the invention, the delay circuit has a series circuit comprising a charging resistor and an integration capacitor. The delay circuit detects the voltage across the measuring resistor by means of the series circuit, which is connected in parallel with said measuring resistor, comprising the charging resistor and the integration capacitor. The charging time constant of the integration capacitor corresponds to the product of the capacitance of the integration capacitor and the nonreactive resistance of the charging resistor. The dimensions of the capacitance of the integration capacitor and the nonreactive resistance of the charging resistor determine this time constant. They determine how long a current can flow through the series circuit comprising the dissipation element and the measuring resistor before the voltage detected in the delay circuit reaches the switching voltage of the shutdown device.

The delay circuit is preferably designed such that, if the voltage across the intermediate circuit capacitor exceeds the maximum voltage, a current flow through the dissipation element can be maintained as long as is possible without there being any risk of the dissipation element or the components in the circuit being destroyed. Even once the dissipation element has been connected, it may be useful not to inactivate the converter immediately via the shutdown device but still to wait as long as possible. This is the case, for example, if a discharge lamp is connected but the gas discharge could not be started quickly enough. As long as the converter has not yet been inactivated, starting of the discharge lamp may still be successful.

A discharge resistor is preferably connected in parallel with the integration capacitor. The capacitance of the integration capacitor and the nonreactive resistance of the discharge resistor determine the discharge time constant of the integration capacitor if the shutdown device itself has a high resistance value.

The integration capacitor and the discharge resistor are preferably dimensioned such that a maximum average power loss over time in the dissipation element cannot be exceeded. As has been mentioned further above, it is possible for the dissipation element to convert large amounts of energy into heat over short periods of time, but it is possible for it to convert only a markedly lower power on average over longer time intervals. If the integration capacitor is discharged too quickly and the converter is reactivated via the shutdown device, it may be that the dissipation element again needs to convert energy into heat. If the time intervals between these events is too short, the dissipation element may be destroyed. The integration capacitor and the discharge resistor therefore need to be dimensioned such that the converter cannot be reactivated too early. On the other hand, the discharge time constant should, however, also not be too great since it may be completely desirable to reactivate the converter after a certain period of time, for example once the discharge lamp has been replaced.

The invention is preferably used for coldstarting a discharge lamp. There are embodiments of electronic ballasts in which the electrodes of a connected discharge lamp are not heated prior to starting of the discharge. In the case of such a coldstarting scenario, the pump circuit is activated as early as when the electronic ballast is first operated, but it is not yet possible for any power to be injected into the lamp. If starting of the discharge does not take place within a sufficiently short period of time, it may be that an undesirable overvoltage occurs across the intermediate circuit capacitor. In such a case, the voltage limitation circuit may reduce the risk of components of the electronic ballast being destroyed. In particular towards the end of the life of a discharge lamp, it may be that the time required for starting is comparatively long.

It may arise that the gas discharge is started too late, not only when coldstarting a discharge lamp, but also when starting a discharge lamp with preheated electrodes. In this case too, the invention can advantageously be used.

BRIEF DESCRIPTION OF THE DRAWING

The invention will be explained in more detail below with reference to an exemplary embodiment. The individual features disclosed thereby may also be essential to the invention in other combinations. The descriptions above and below relate to the apparatus aspect and the method aspect of the invention without this explicitly being mentioned in detail.

The FIG. 1 shows a circuit arrangement according to the invention.

PREFERRED EMBODIMENT OF THE INVENTION

Figure 1:
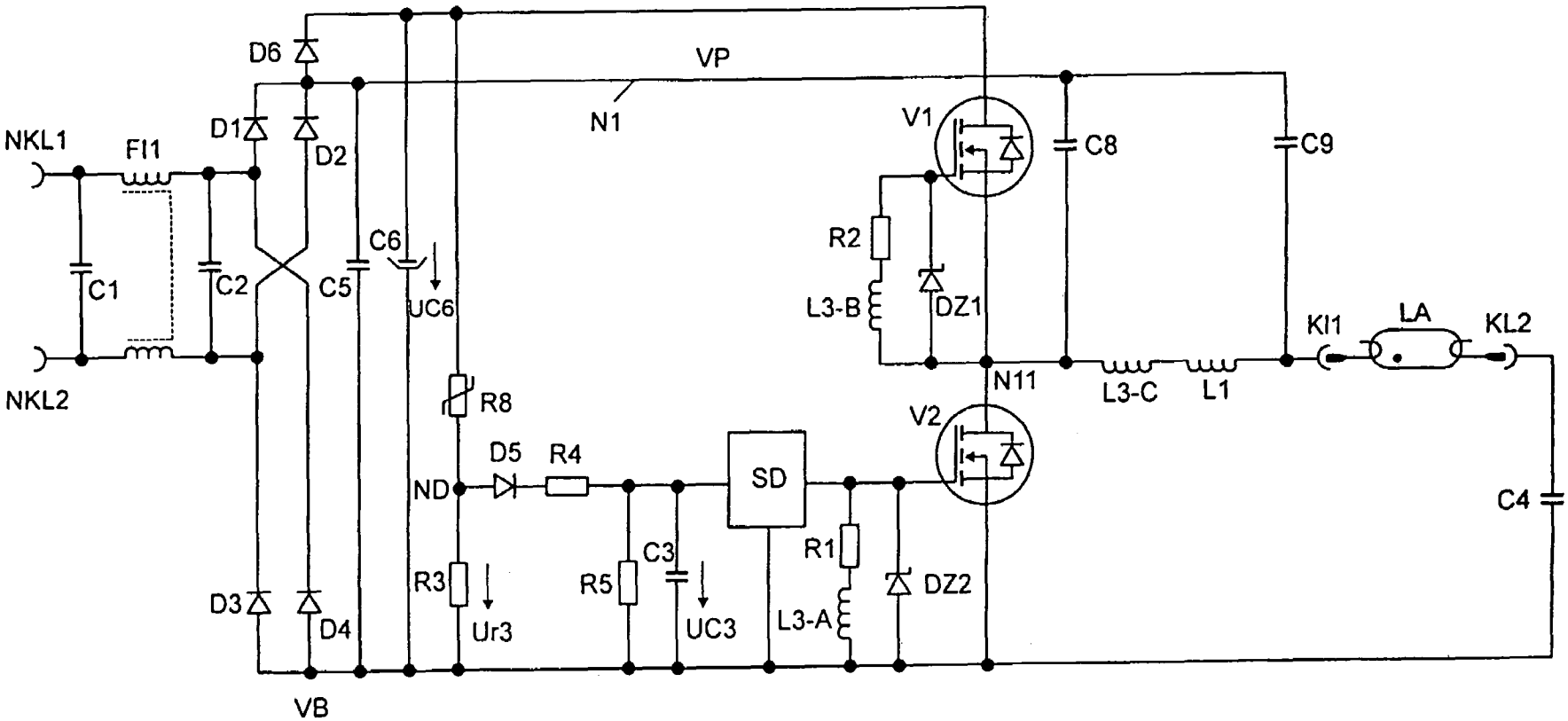

The FIGURE shows a circuit arrangement according to the invention which is to be understood as being part of an electronic ballast with a connected discharge lamp.

Illustrated on the left-hand side are two system supply terminals NKL1 and NKL2, at which a system supply can be connected to the electronic ballast. A filter comprising two capacitors C1 and C2 and two coupled coils, denoted by FI1, connect the system supply terminals NKL1 and NKL2 to a full-bridge rectifier comprising the diodes D1 to D4. The rectified supply voltage is applied to an intermediate circuit capacitor C6, which is illustrated to the right of the full-bridge rectifier in the FIGURE, via a pump switch diode D6 which is connected to the cathode-side end of the full-bridge rectifier D1 to D4. The voltage UC6 drops across the intermediate circuit capacitor C6.

At the anode-side output of the full-bridge rectifier, the reference potential VB is applied. At the cathode-side output of the full-bridge rectifier, at a connection node N1 between the full-bridge rectifier and the pump switch diode D6, the positive rectified supply voltage VP is applied. An interference suppression capacitor C5 for the purpose of reducing system current harmonics is connected in parallel with the full-bridge rectifier D1 to D4.

The intermediate circuit capacitor C6 feeds a supply power to the converter, which in this case is in the form of a half bridge comprising two switching elements V1 and V2. The switching elements V1 and V2 are in this case in the form of MOSFETs. By means of opposite clocking, they produce an AC potential at the connection node between them, their center tap NM, said AC potential oscillating between the reference potential VB and the supply potential UC6 of the intermediate circuit capacitor.

A series circuit comprising a lamp inductor L1, lamp terminals KL1 and KL2 and a coupling capacitor C4 is connected between the center tap NM and the reference potential VB. A discharge lamp LA is connected to the lamp terminals KL1 and KL2.

A transformer coil L3-C is connected in series with the center tap NM. A series circuit comprising a resistor R2 and a transformer coil L3-B is connected between the center tap NM of the converter and the gate of the switching element V1 on the supply-potential side. A corresponding series circuit comprising a resistor R1 and a transformer coil L3-A is connected between the reference potential VB and the gate of the switching element V2. A zener diode DZ1 or DZ2 for the overvoltage protection of the switching element V1 or the switching element V2 is connected in each case in parallel with these series circuits comprising one of the resistors R2 and R1 and one of the transformer coils L3-B and L3-A, respectively. The three transformer coils L3-A, L3-B and L3-C are transformer-coupled to one another and symbolically represent a self-excited controller for the switching times of the switching elements V1 and V2.

A pump capacitor C9 is connected between the node N1 and the left-hand lamp terminal KL1. A trapezoidal capacitor C8 is connected in parallel with this pump capacitor, but to the center tap NM. The trapezoidal capacitor C8 influences the switching response over time of the switching elements V1 and V2 and thus reduces switching losses. In this case, the capacitors C8 and C9 are denoted, together with the lamp inductor L1, as the pump network. The pump network C8, C9, L1 forms a pump branch together with the pump switch diode D6. However, virtually any desired pump network topologies are conceivable. It is critical that the pump network contains at least one energy store, which is connected to the intermediate circuit capacitor C6 via a pump switch.

A series circuit comprising a varistor R8 and a measuring resistor R3 is connected in parallel with the intermediate circuit capacitor C6. A node ND is located between the varistor R8 and the measuring resistor R3. A delay circuit comprising a diode D5, an integration resistor R4, a discharge resistor R5 and an integration capacitor C3 is connected between the node ND and the reference potential VB. In this case, the diode D5 is connected in series with the integration resistor R4 and the integration capacitor C3. The discharge resistor R5 is connected in parallel with the integration capacitor C3. A shutdown device SD is connected to the connection node between the integration resistor R4 and the integration capacitor C3 via a highly resistive input. A deactivation output of the shutdown device SD is connected to a control input of the switching element V2.

During normal operation, when the discharge lamp LA is connected and the gas discharge has been ignited, the pump circuit functions as follows: the center tap NM of the converter oscillates at a high frequency between the reference potential VB and the supply potential UC6 of the intermediate circuit capacitor C6. The coupling capacitor C4 is designed such that the potential NH at the lamp terminal KL2 on the reference-potential side corresponds to approximately half the voltage UC6 across the intermediate circuit capacitor C6. Driven by the oscillating potential at the center tap NM, firstly the discharge lamp LA is operated and secondly charge is pumped via the pump switch diode D6 into the intermediate circuit capacitor C6 via the pump network comprising the capacitors C8 and C9 and the lamp inductor L1.

In the event of coldstarting of a discharge lamp LA, the following takes place in a circuit arrangement as shown in FIG. 1: charge is pumped into the intermediate circuit capacitor via the pump switch diode D6 by means of the pump network C8, C9 and L1. The more switching operations the converter carries out prior to the gas discharge being ignited in the discharge lamp LA, the greater the increase in the voltage UC6 across the intermediate circuit capacitor C6.

The gas discharge in the discharge lamp LA is normally ignited within a time interval in which the voltage UC6 across the intermediate circuit capacitor C6 is not yet critical. If the gas discharge does not ignite, the voltage UC6 across the intermediate circuit capacitor C6 may reach such high values that components in the electronic ballast, in particular the intermediate circuit capacitor C6 itself, may be destroyed. The circuit arrangement shown in FIG. 1 should reduce this risk.

If an overvoltage occurs at the capacitor C6, the otherwise highly resistive varistor R8 assumes a low resistance value, and a current flows through the series circuit comprising the varistor R8 and the measuring resistor R3. In this case, the varistor may dissipate high powers for a short period of time. The voltage at which the varistor R8 assumes a low resistance value may vary severely from type to type, and also over the life of such a varistor; 10% are not unusual in both cases.

The delay circuit which is connected in parallel with the measuring resistor R3 detects the voltage UC3 across the measuring resistor R3. In this case, the voltage is stored in the integration capacitor C3. How rapidly the voltage UC3 across the integration capacitor C3 increases depends on the dimensions of the components in the delay circuit. The charging time constant is given by the nonreactive resistance of the integration resistor R4 and the capacitance of the integration capacitor C3. The discharge time constant is in this case given by the capacitance of the integration capacitor C3 and the nonreactive resistance of the discharge resistor R5. If the discharge time constant is greater than the charging time constant, the voltage UC3 across the integration capacitor C3 is proportional to the charge which has flowed through the measuring resistor R3 since the connection of the varistor R8.

The charging time constant for the integration capacitor C3 is set such that a current flow through the series circuit comprising the varistor R8 and the measuring resistor R3 can be maintained as long as is possible without the varistor R8 being destroyed. The discharge lamp LA is thus given as long as possible to ignite the gas discharge. If the voltage across the integration capacitor C3 exceeds the switching threshold of the shutdown device SD, the shutdown device SD deactivates the switching element V2 of the converter. The voltage UC6 across the intermediate circuit capacitor C6 therefore cannot rise any further. The integration capacitor C3 is discharged via the discharge resistor R5. This takes place slowly in comparison with charging of the integration capacitor C3.

The shutdown device SD is a bistable shutdown device, i.e. it is activated when a first switching threshold is exceeded and thus the converter is deactivated, and activates the converter when a second, smaller switching threshold is undershot. The discharge time constant for the discharge of the integration capacitor C3 is set such that the converter is only reactivated after a comparatively long period of time. The reason for this is the fact that the varistor R8, when averaged over longer intervals, cannot dissipate nearly as much power as during very short intervals. A radiofrequency converter—activation/deactivation cycle therefore needs to be prevented such that the average power consumption over time of the varistor does not exceed the corresponding limit value.

On the other hand, it is expedient to reactivate the converter after a certain period of time since the event of the gas discharge not being ignited may be an event which occurs only once or since, in the meantime, the discharge lamp LA has been replaced.

The invention claimed is:

1. An electronic ballast for operating a discharge lamp (LA), which has:

a converter (V1, V2) for producing a radiofrequency AC voltage, an intermediate circuit capacitor (C6) for supplying (UC6) a DC voltage to the converter (V1, V2), and a pump circuit (D6, C8, C9, L1), which charges the intermediate circuit capacitor (C6) from the AC voltage of the converter (V1, V2), characterized by a voltage limitation circuit (R8, R3, D5, R4, R5, C3, SD), which is connected in parallel with the intermediate circuit capacitor (C6), for limiting the voltage (UC6) across the intermediate circuit capacitor (C6), which has:

a series circuit (R3, R8) having a dissipation element (R8) and a measuring resistor (R3), a delay circuit (R4, R5, C3), and a shutdown device (SD), which has a threshold value element (DZ3), which defines a switching voltage (UC3) across the delay circuit (R4, R5, C3), and whose output signal deactivates the converter (V1, V2) when the maximum voltage (UC3) is exceeded, the dissipation element (R8) converting electrical energy into thermal energy when a maximum value for the voltage (UC6) across the intermediate circuit capacitor (C6) determined by the dissipation element is exceeded, and the current through the measuring resistor (R3) being measured as the voltage (UR3) across said measuring resistor (R3), being detected in the delay circuit (R4, R5, C3), and being fed to the shutdown device (SD) as the input signal (UC3).

2. The electronic ballast as claimed in claim 1, in which the dissipation element (R8) is a varistor.

3. The electronic ballast as claimed in claim 1, in which the shutdown device (SD) is in the form of a bistable shutdown device (SD).

4. The electronic ballast as claimed in claim 1, in which the shutdown device (SD) has a zener diode (DZ3) as the threshold value element.

5. The electronic ballast as claimed in claim 1, in which the delay circuit (R4, R5, C3) detects the voltage (UR3) across the measuring resistor (R3) via a series circuit, which is connected in parallel with said measuring resistor (R3), comprising a charging resistor (R4) and an integration capacitor (C3).

6. The electronic ballast as claimed in claim 1, in which the delay circuit (R4, R5, C3) is designed such that, if the voltage (UC6) across the intermediate circuit capacitor (C6) exceeds the maximum voltage, a current flow through the dissipation element (R8) can only be maintained as long as is possible without the dissipation element (R8) being destroyed.

7. The electronic ballast as claimed in claim 1 for cold-starting a discharge lamp.

8. The electronic ballast as claimed in claim 1 for operating a low-pressure discharge lamp.

9. The electronic ballast as claimed in claim 5, in which a discharge resistor (R5) is connected in parallel with the integration capacitor (C3).

10. The electronic ballast as claimed in claim 9, in which the integration capacitor (C3) and the discharge resistor (R5) are designed such that a maximum average power loss over time in the dissipation element (R8) cannot be exceeded.

11. A method for operating an electronic ballast for a discharge lamp (LA), in which:

a converter (V1, V2) produces a radiofrequency AC voltage, an intermediate circuit capacitor (C6) supplies a DC voltage to the converter (V1, V2), and a pump circuit (D6, C8, C9, L1) charges the intermediate circuit capacitor (C6) from the AC voltage of the converter (V1, V2), characterized in that a voltage limitation circuit (R8, R3, D5, R4, R5, C3, SD), which is connected in parallel with the intermediate circuit capacitor (C6), limits the voltage (UC6) across the intermediate circuit capacitor (C6), which voltage limitation circuit (R8, R3, D5, R4, R5, C3, SD) has:

a series circuit (R3, R8) comprising a dissipation element (R8) and a measuring resistor (R3), a delay circuit (R4, R5, C3), and a shutdown device (SD), which has a threshold value element (DZ3), which defines a switching voltage (UC3) across the delay circuit (R4, R5, C3), and whose output signal deactivates the converter (V1, V2) when the maximum voltage (UC3) is exceeded, the dissipation element (R8) converting electrical energy into thermal energy when a maximum value for the voltage (UC6) across the intermediate circuit capacitor (C6) determined by the dissipation element is exceeded, and the current through the measuring resistor (R3) being measured as the voltage (UR3) across said measuring resistor (R3), being detected in the delay circuit (R4, R5, C3), and being fed to the shutdown device (SD) as the input signal (UC3).

12. The method as claimed in claim 11, in which the maximum voltage (UC6) across the intermediate circuit capacitor (C6) is exceeded prior to the start of the discharge, with the result that the dissipation element (R8) converts electrical energy into thermal energy and the shutdown device (SD) inactivates the converter.

13. The method as claimed in claim 12, in which the electrodes of the discharge lamp (LA) are not heated prior to starting, rather coldstarting is carried out.

* * * * *